US006098235A

United States Patent [19]

Tomm et al.

[11] Patent Number: 6,098,235

[45] Date of Patent: Aug. 8, 2000

[54] MOP HEAD SECUREMENT DEVICE

[75] Inventors: Erwin Tomm, Cleveland; Franciszek Urbanczyk, Valley View, both of Ohio

[73] Assignee: Erwin Tomm, Cleveland, Ohio

[21] Appl. No.: 09/362,519

[22] Filed: Jul. 28, 1999

Related U.S. Application Data

[60] Provisional application No. 60/120,525, Feb. 17, 1999.

[51] Int. Cl.[7] ..... A47L 13/258

[52] U.S. Cl. ..... 15/150; 15/147.1; 15/229.2

[58] Field of Search ..... 15/147.1, 150, 15/228, 229.2, 229.6, 151, 152, 153, 154

[56] References Cited

U.S. PATENT DOCUMENTS

| | | | |
|---|---|---|---|
| 116,512 | 6/1871 | Todd | 15/150 |
| 283,121 | 8/1883 | Lee | 15/150 |
| 1,376,175 | 4/1921 | Sundermann, Jr. | 15/150 |
| 3,457,581 | 7/1969 | Oas | 15/147.1 |
| 3,688,331 | 9/1972 | Saltzstein | 15/150 |
| 4,287,632 | 9/1981 | Hammond . | |
| 4,553,282 | 11/1985 | Batchelor . | |
| 5,724,696 | 3/1998 | Di Giammarino . | |
| 5,918,340 | 7/1999 | Young | 15/150 |

*Primary Examiner*—Randall E. Chin
*Attorney, Agent, or Firm*—Fay, Sharpe, Fagan, Minnich & McKee, LLP

[57] ABSTRACT

A mop head securement device includes a shank adapted for receipt of a mop handle. An upper jaw projects outwardly from the shank and a lower jaw member is pivotally connected to the first end of the upper jaw member. An opposite end of the lower jaw defines a lower latch member. A lever arm has a first portion depending from the upper jaw member toward the lower jaw member, and a second portion extending upwardly away from the lower jaw member. The first portion of the lever arm defines an upper latch member adapted for selective engagement with the lower latch member of the lower jaw. The lever arm is manually movable between a latched position, where the upper latch member is positioned to engage the lower latch member, and an unlatched position. The lower jaw member is movable between: (i) a closed, mop head retaining position; and, (ii) an open position wherein the upper and lower latch members are disengaged and the lower jaw member is pivoted away from the upper jaw member. A resilient member is connected to the lever arm and the shank and biases the lever arm into its latched position. A locking tab on the lever arm pivots between locked and unlocked positions.

18 Claims, 4 Drawing Sheets

MOP HEAD SECUREMENT DEVICE

CROSS-REFERENCE TO RELATED APPLICATION

This application claims priority from U.S. Provisional Application No. 60/120,525 filed Feb. 17, 1999 (02/17/99).

BACKGROUND OF THE INVENTION

The present application relates to a device for operatively securing a wet mop head at the distal end of an elongated mop handle. More particularly, it relates to a mop head securement device that conveniently and effectively secures mop head in an operative position, and that allows for convenient selective removal of a used mop head as desired.

Prior devices for retaining wet mop heads are disclosed in U.S. Pat. Nos. 4,553,282; 4,287,632; and, 5,724,696, each of which is hereby expressly incorporated by reference herein. The devices described in the aforementioned U.S. Patents have been found to be deficient for a wide variety of reasons. For example, none of these prior devices allow a user to maintain a firm and secure grip on a mop handle extending therefrom, while at the same time allowing the user to open the mop head retainer using one hand. Therefore, these prior devices are not well-suited for allowing a user to keep one of his/her hands free for manipulation of the mop head, itself, or for other activities.

Another deficiency associated with the mop head retainers disclosed in the '632 and '696 patents is that destructive forces are exerted on the "release member," i.e., the deformable member upon which a user pushes downward (either by hand or by a pressure bar) to open the mop head retainer. Over even a short time, these forces applied to the release member cause it to separate from the remainder of the mop head retainer. Once this occurs, the mop head retainer is rendered ineffective.

Another deficiency associated with prior mop head retaining devices is their failure to secure the mop head against movement after prolonged periods of use. Of course, once the mop head moves out of its operative position, its effectiveness is greatly diminished.

In light of these deficiencies and others associated with conventional mop head retaining devices, there has been found a need for a new and improved device for operatively securing a wet mop head that is effective, easy and convenient to use, and durable.

SUMMARY OF THE INVENTION

In accordance with the present invention, a new and improved mop head securement device is provided.

In accordance with a first aspect of the present invention, a mop head securement device includes a shank adapted for receipt of a mop handle. An upper jaw projects outwardly from the shank and a lower jaw member is pivotally connected to the first end of the upper jaw member. An opposite end of the lower jaw defines a lower latch member. A lever arm is arranged generally transverse and connected to the second end of the upper jaw member. The lever arm has a first portion depending from the upper jaw member toward the lower jaw member, and a second portion extending upwardly away from the lower jaw member. The first portion of the lever arm defines an upper latch member adapted for selective engagement with the lower latch member of the lower jaw. The lever arm is manually movable between a latched position, where the upper latch member is positioned to engage the lower latch member, and an unlatched position. The lower jaw member is movable between: (i) a closed, mop head retaining position wherein the upper and lower latch members are engaged with each other and the lower jaw member is placed in spaced parallel relation to the upper jaw member so that a mop head retaining spaced is defined between the upper and lower jaw members; and, (ii) an open position wherein the upper and lower latch members are disengaged and the lower jaw member is pivoted away from the upper jaw member.

One advantage of the present invention is the provision of a new and improved mop head securement device.

Another advantage of the present invention resides in the provision of a mop head securement device that secures an associated mop head in the preferred operative position, even after periods of extended use.

A further advantage of the present invention is found in the provision of a mop head securement device that is adapted for convenient one-handed operation in a "trigger-like" fashion so that a user is able to use a free hand to remove a used mop head from and/or to install a new mop head in the mop head securement device.

Still another advantage of the present invention is the provision of a new and improved mop head securement device that is resistant to inadvertent opening upon contact with furniture and other objects during use.

Yet another advantage of the present invention is found in the provision of a mop head securement device that locks in a latched position to prevent accidental opening of the device.

Still other benefits and advantages of the present invention will become apparent to those of ordinary skill in the art upon reading and understanding this application in conjunction with the accompanying drawings.

BRIEF DESCRIPTION OF THE DRAWINGS

The invention takes form from various components and arrangements of components, preferred embodiments of which are illustrated in the accompanying drawings that form a part hereof and wherein.

DETAILED DESCRIPTION OF THE INVENTION

Figure 1:
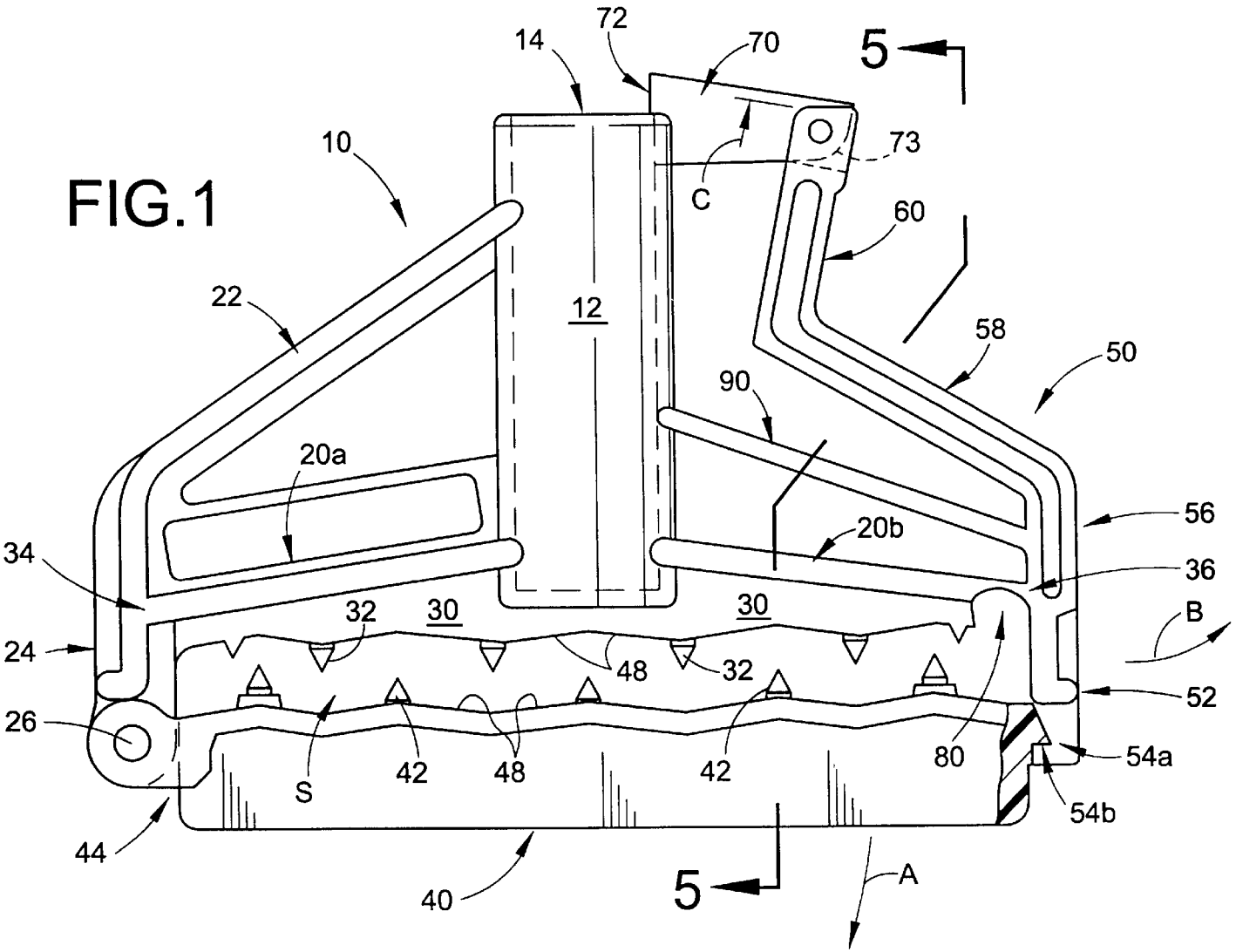
FIG. 1 is a front elevational view, with a portion broken away, of a mop head securement device formed in accordance with the present invention, wherein the device is in a mop head retaining position.

Referring now to the drawings, wherein the showings are for purposes of illustrating preferred embodiments of the invention and not for limiting same, FIGS. 1–5 depict a mop head securement device 10 formed in accordance with the present invention from molded polypropylene or another suitable conventional plastic or other material. The device 10 includes a hollow shank 12 defining a bore adapted to receive a mop handle at an open upper end 14, and the mop handle is secured therein by conventional means. First and second cross members 20*a*,20*b* project outwardly from opposite locations of the lowermost end of the shank 12. Together, the cross members 20*a*,20*b* define a generally horizontally extending upper jaw 30 having teeth 32 projecting downwardly therefrom. The upper jaw 30 has opposite first and second outermost ends 34,36.

The first end 34 of the upper jaw 30 is interconnected to an upper portion of the shank 12 by a brace 22. A lower jaw member 40, including upwardly projecting teeth 42, is pivotally connected at its first end 44 to a depending portion 24 of the upper jaw 30 at the jaw first end 34 by way of a hinge 26, that may be a conventional hinge or a living hinge.

A lever arm 50 is connected to the upper jaw second end 36 by means of a living hinge 80. A first, lowermost end 52 of the lever arm 50 extends downwardly beyond the upper jaw 30 and includes or defines a first or upper latch member 54*a*. A mating lower latch member 54*b* is included on or defined by a second end 46 of the lower jaw 40. Thus, the second end 46 (FIG. 2) of the lower jaw is selectively connected to the depending portion 52 of the lever arm 50 by means of the mating latch members 54*a*,54*b* to provide a mop head retaining position (FIG. 1) for the device 10. In this mop head retaining position, the upper and lower jaws 30,40 are arranged generally parallel and spaced-apart so that a mop head receiving space S is defined therebetween. The head of a wet mop such as a yarn-type or other type of wet mop is secured in the space S (FIG. 1) and prevented from movement relative to the device 10 by the teeth 32,42. The upper and lower jaws 30,40 preferable include or define wavy regions or projections 48 which further grip a mop head placed between the jaws 30,40.

The lever arm 50 also includes a second, upwardly extending portion defined by a first leg 56 projecting above the jaw second end 36, preferably generally perpendicular to the upper jaw member 30. This upwardly extending leg 56 is connected to a second leg 58 that extends inwardly toward the shank 12 and upwardly away from the upper jaw member 30. Finally, a generally upwardly extending third leg defines a trigger portion 60 at the second end of the lever arm 50 that lies sufficiently close to the shank 12 to be operated with one hand as described below. The trigger portion 60 is preferably contoured to provide an ergonomic surface for being gripped by a user as described below. The lever arm 50 is not connected to and does not extend from the shank 12.

A locking tab 70 is hingedly connected to the uppermost second end of the lever arm 50 and pivots along an arc C between a locked position (FIG. 1), wherein an end 72 thereof lies adjacent and/or abuts the shank 12 (or a mop handle inserted in the shank) and prevents inward movement of the lever arm 50 toward the shank 12, and an unlocked position (FIG. 2), wherein the end 72 is moved out of abutment or adjacency with the shank 12 so that the lever arm 50 is selectively moveable toward the shank 12. The shank 12 preferably includes a notch N defined therein to receive the locking tab 70 when the tab is placed in the locked position of FIG. 1. The notch N (FIG. 3) acts to support the locking tab 70 in this position and also prevents lateral or "sideways" movement of the tab and lever arm 50 as can result in breakage of the arm 50. Opposite the end 72, the end 73 of the tab 70 abuts the trigger portion 60 of the lever arm 50 to define the unlocked position shown in FIG. 2.

The living hinge 80 is defined in the upper jaw 30, near the second end 36. The living hinge 80 facilitates pivotal movement of the lever arm 50 relative to the upper jaw 30 on an arc B so that the latch member 54*a* is selectively moved away from and out of engagement with the latch member 54*b* on the end 46 of the lower jaw 40. The lever arm 50 pivots along the arc B from the latched position (FIG. 1) to the unlatched position (FIG. 2).

Figure 2:
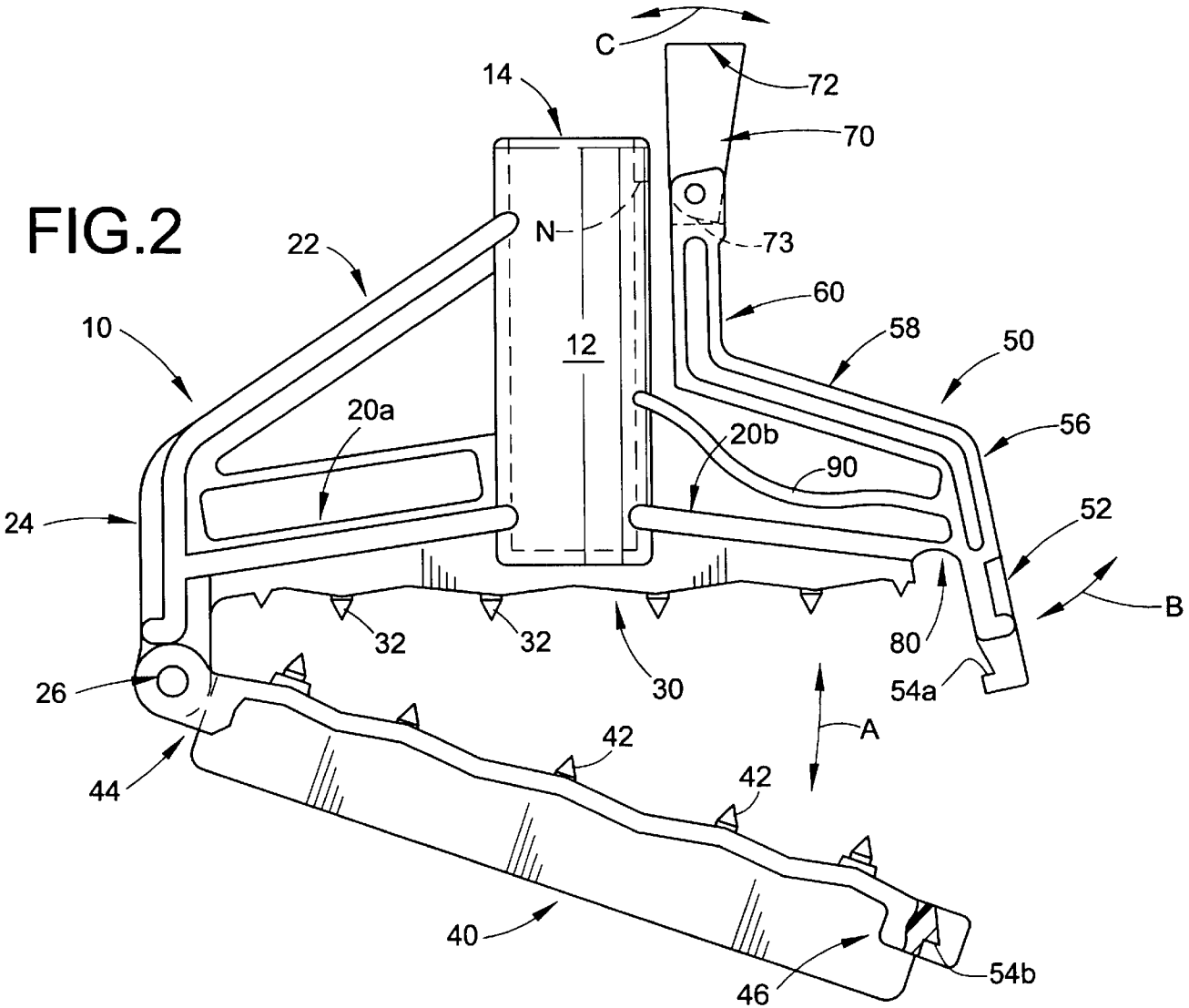
FIG. 2 illustrates the device of FIG. 1 shown in its open position, with the lever arm in its unlatched position.
Figure 3:
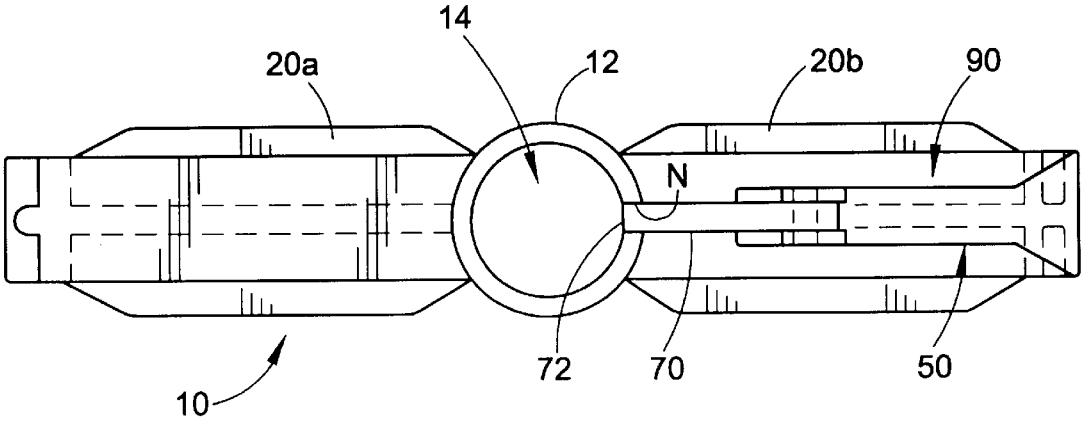
FIG. 3 is a top plan view of the device of FIG. 1.
Figure 4:
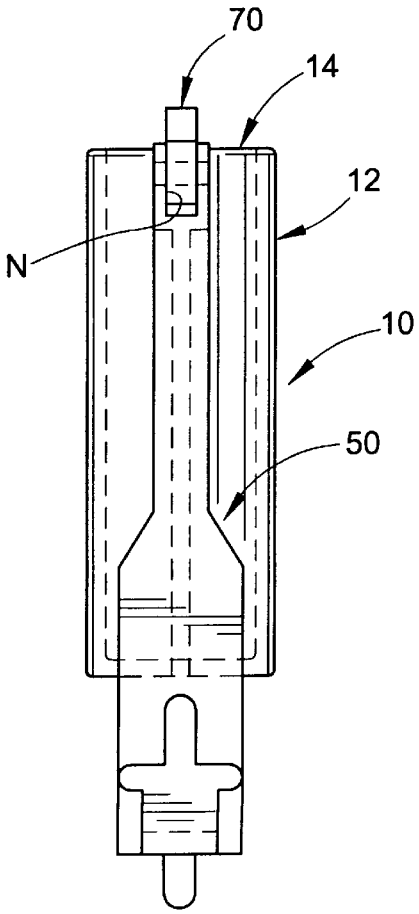
FIG. 4 is a right side elevational view of the device shown in FIG. 1.
Figure 5:
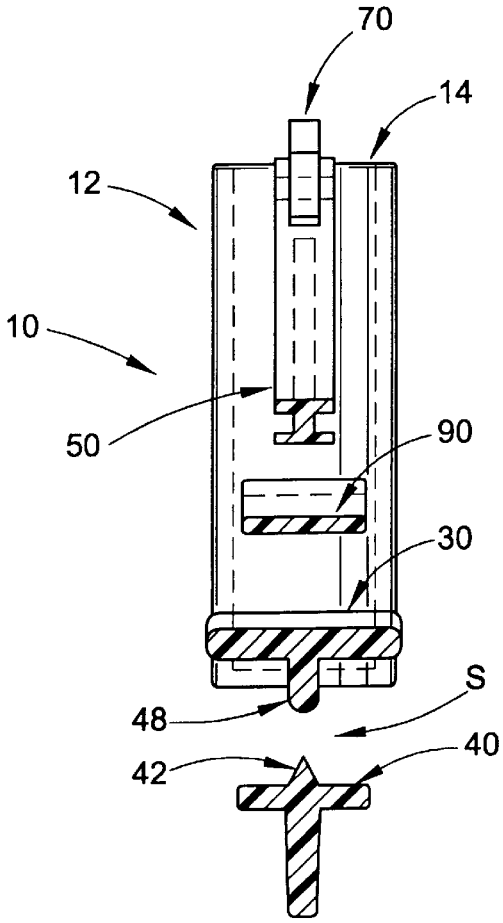
FIG. 5 is a cross-sectional view along line 5—5 of FIG. 1.

With particular reference to FIG. 2, when the lever arm 50 is in the unlatched position, the lower jaw 40 is allowed to pivot away from the upper jaw 30 along an arc A to define an open position of the device 10. In this open position, a yarn-type mop or other mop head is able to be placed in or removed from the space S between the jaws 30,40.

A biasing member 90 is positioned between the upwardly extending vertical section 56 of the lever arm 50 and the shank 12 and biases the lever arm 50 into the latched position. When the trigger portion 60 of the lever arm 50 is moved toward the shank 12 to unlatch the members 54*a*,54*b*, the biasing member 90 temporarily deforms as shown in FIG. 2. Upon pressure being released from the trigger portion 60 of the lever 50, the biasing member 90 returns to its extended state to urge the lever arm 50 into the latched position of FIG. 1.

For installation of an associated mop head, the tab 70 is moved to the unlocked position (FIG. 2) and the trigger portion 60 of the lever arm 50 is moved inwardly toward the shank 12, preferably by being squeezed in a one-handed manner by a user. This, then, pivots the lower portion 52 of the arm 50 outward along the arc B so that the latch members 54*a*,54*b* are disengaged. This allows the jaw 40 to pivot away from the jaw 30 along the arc A. A mop head is then placed in the space S and the lower jaw 40 is pivoted along the arc A into the mop head retaining position (FIG. 1) so that the latch members 54*a*,54*b* engage. The wavy portions 48 of both jaws 30,40 and teeth 32,42 grippingly engage the mop head. The biasing member 90 maintains the lever arm 50 in its latched position and, consequently, the device 10 is in its mop head retaining position. The tab 70 is then pivoted into the locked position (FIG. 1) so that inadvertent inward movement of the trigger portion 60 of the lever arm 50 is prevented. Removal of an associated mop head from the device 10 is carried out by pivoting the tab 70 to its unlocked position, squeezing the trigger portion 60 of the lever arm 50 toward the shank 12, and moving the lower jaw member 40 away from the upper jaw member 30 along the arc A. Once the device 10 is in its open position, an associated mop head is freely removed therefrom.

Figure 6:
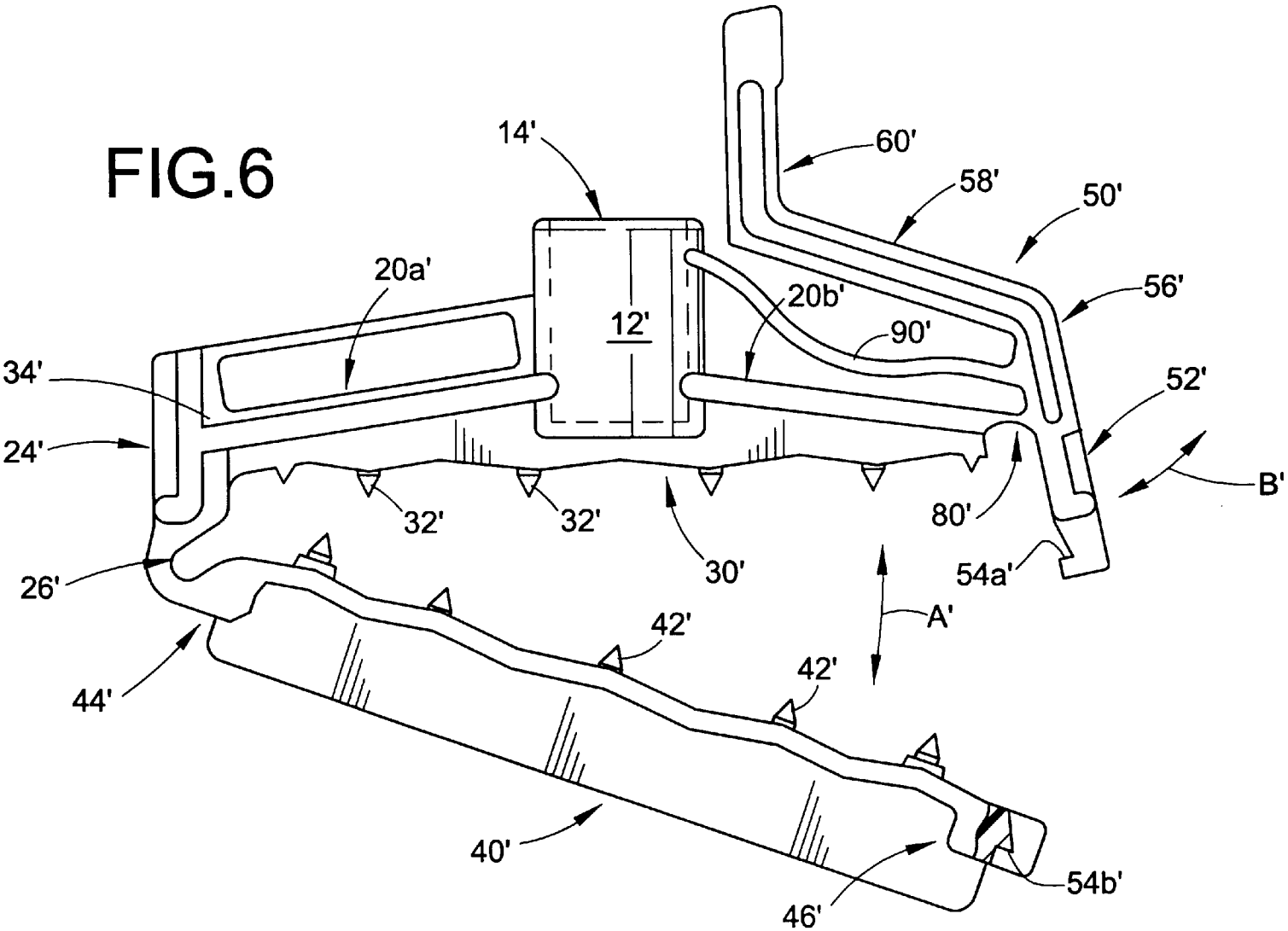
FIG. 6 is a front elevational view of an alternative embodiment of the present invention in its open position.

FIG. 6 illustrates a mop head securement device 10' formed in accordance with an alternative embodiment of the present invention. Except as shown and described herein, the device 10' is similar in all respects to the device 10. Consequently, like components relative to the device 10 are identified with like reference numerals/letters. Specifically, the device 10' is identical in all respects to the device 10, except that the device 10' includes a shortened shank 12' so that the trigger portion 60' of the lever arm 50' extends substantially above the open upper end 14' of the shank 12', and the first end 34' of the upper jaw 30' is self-supporting rather than braced to the shank 12'. Furthermore, the trigger portion 60' of the lever arm 50' does not include a locking tab. Finally, the hinge 26' is preferably a living hinge as shown.

The invention has been described with reference to a preferred embodiment. Obviously, modifications and alterations will occur to others upon reading and understanding the preceding specification. It is intended that the invention be construed as including all such modifications and alterations.

What is claimed is:

1. A mop head securement device comprising:

a shank including a bore adapted for receipt of a mop handle at an upper shank end;

an upper jaw member projecting outwardly from said shank, said upper jaw member having opposite first and second ends;

a lower jaw member having a first end pivotally connected to the first end of the upper jaw member and an opposite second end defining a lower latch member;

a lever arm arranged generally transverse and connected to the second end of the upper jaw member by a living hinge, said lever arm having a first portion depending from the upper jaw member toward the lower jaw member, and a second portion extending upwardly away from the lower jaw member, said first portion of said lever arm defining an upper latch member adapted for selective engagement with said lower latch member of said lower jaw, said lever arm manually movable between a latched position, wherein said upper latch member is positioned to engage said lower latch member, and an unlatched position, wherein said lower jaw member is movable between: (i) a closed, mop head retaining position wherein said upper and lower latch members are engaged with each other and said lower jaw member is placed in spaced relation to the upper jaw member so that a mop head retaining space is defined between the upper and lower jaw members; and, (ii) an open position wherein said upper and lower latch members are disengaged and said lower jaw member is pivoted away from said upper jaw member.

2. The mop head securement device as set forth in claim 1, wherein said second portion of said lever arm comprises a first leg extending upwardly away from said upper jaw member, a second leg extending from said first leg upwardly away from said upper jaw member and inwardly toward said shank, and a third leg extending from said second leg upwardly away from said upper jaw member adjacent said shank, said third leg defining a trigger by which a user of said mop head securement device can move said second portion of said lever arm toward said shank so as to place said lever arm in said unlatched position.

3. The mop head securement device as set forth in claim 2, further comprising:

a locking tab pivotally connected to said third leg of said lever arm and movable between a locked position wherein said locking tab abuts one of said shank and a handle secured in said shank so as to prevent movement of said third leg of said lever arm toward said shank, and an unlocked position wherein said locking tab is moved away from said shank.

4. The mop head securement device as set forth in claim 3, wherein said shank defines a notch adapted for receipt of said locking tab when said tab is moved into said locked position, said notch providing a stop to define said locked position of said tab and preventing lateral movement of said lever arm when said tab is received in said notch.

5. The mop head securement device as set forth in claim 1, further comprising:

means for biasing said lever arm into said latched position.

6. The mop head securement device as set forth in claim 1, further comprising:

a resilient biasing member operatively associated with said lever arm for urging said lever arm into said latched position.

7. The mop head securement device as set forth in claim 6, wherein said resilient member extends between and interconnects said shank and said second portion of said lever arm, said resilient member selectively deformable when said lever arm is moved into said unlatched position from said latched position.

8. The mop head securement device as set forth in claim 1, further comprising:

a brace interconnecting said first end of said upper jaw member to said shank in the region of said upper shank end.

9. The mop head securement device as set forth in claim 1, wherein said upper and lower jaw members define wavy mop head gripping formations and teeth projecting outwardly from the wavy gripping formations into said mop head retaining space when said lower jaw is in its closed, mop head retaining position, said teeth and wavy formations cooperating to fixedly secure an associated mop head in said mop head retaining space.

10. A mop head securement device comprising:

a shank adapted for connection to a mop handle at an upper shank end;

an upper jaw member projecting outwardly from said shank, said upper jaw member having opposite first and second ends;

a lower jaw member having a first end and an opposite second end that includes a lower latch member;

a lever arm connected to the upper jaw member and having a first portion depending toward the lower jaw member and a second portion extending upwardly away from the lower jaw member, said first portion of said lever arm defining an upper latch member adapted for selective engagement with said lower latch member of said lower jaw, said lever arm manually movable between a latched position, wherein said upper latch member is positioned to engage said lower latch member, and an unlatched position, said lower jaw member movable between: (i) a closed, mop head retaining position wherein said upper and lower latch members are engaged with each other and said lower jaw member is placed in spaced relation to the upper jaw member so that a mop head retaining space is defined between the upper and lower jaw members; and, (ii) an open position wherein said upper and lower latch members are disengaged and said lower jaw member is pivoted away from said upper jaw member; and, a resilient biasing member operatively associated with said lever arm for urging said lever arm into said latched position.

11. The mop head securement device as set forth in claim 10, wherein said lever arm is connected to the second end of the upper jaw member by a living hinge.

12. The mop head securement device as set forth in claim 10, wherein said second portion of said lever arm comprises a first leg extending upwardly away from said upper jaw member, a second leg extending from said first leg upwardly away from said upper jaw member and inwardly toward said shank, and a third leg extending from said second leg upwardly away from said upper jaw member adjacent said shank, said third leg defining a trigger by which a user of said mop head securement device can move said second portion of said lever arm toward said shank so as to place said lever arm in said unlatched position.

13. The mop head securement device as set forth in claim 12, further comprising:

a locking tab pivotally connected to said third leg of said lever arm and movable between a locked position wherein said locking tab abuts one of said shank and a handle secured in said shank so as to prevent movement of said third leg of said lever arm toward said shank, and an unlocked position wherein said locking tab is moved away from said shank.

14. The mop head securement device as set forth in claim 13, wherein said shank defines a notch adapted for receipt of said locking tab when said tab is moved into said locked position, said notch providing a stop to define said locked position of said tab and preventing lateral movement of said lever arm when said tab is received in said notch.

15. The mop head securement device as set forth in claim 10, wherein said resilient member extends between and interconnects said shank and said second portion of said lever arm, said resilient member selectively deformable when said lever arm is moved into said unlatched position from said latched position.

16. The mop head securement device as set forth in claim 10, further comprising:

a brace interconnecting said first end of said upper jaw member to said shank in the region of said upper shank end.

17. The mop head securement device as set forth in claim 10, wherein said upper and lower jaw members define wavy mop head gripping formations and teeth projecting outwardly from the wavy gripping formations into said mop head retaining space when said lower jaw is in its closed, mop head retaining position, said teeth and wavy formations cooperating to fixedly secure an associated mop head in said mop head retaining space.

18. A mop head retainer comprising:

a shank;

an upper jaw member connected to said shank, said upper jaw member having opposite first and second ends;

a lower jaw member having a first end and an opposite second end that, includes a lower latch member;

a lever arm connected to the upper jaw member and having a first portion depending from the upper jaw member toward the lower jaw member, and a second portion extending upwardly away from the lower jaw member, said first portion of said lever arm including an upper latch member adapted for selective engagement with said lower latch member of said lower jaw, said lever arm manually movable between a latched position, wherein said upper latch member is positioned to engage said lower latch member, and an unlatched position, wherein said lower jaw member is movable between a closed, mop head retaining position and an open position, at least one of said upper and lower jaw members defining wavy mop head gripping formations and teeth projecting outwardly therefrom, said teeth and wavy formations cooperating to fixedly secure an associated mop head in a mop head retaining space defined between said upper and lower jaw members when said lower jaw member is placed in its closed, mop head retaining position.

* * * * *